US007331194B2

(12) United States Patent
Lefkowitz et al.

(10) Patent No.: US 7,331,194 B2
(45) Date of Patent: Feb. 19, 2008

(54) COASTER

(75) Inventors: Brian Lefkowitz, Chicago, IL (US); Michael Wax, Chicago, IL (US)

(73) Assignee: The Blue Swing LLC, Chicago, IL (US)

( * ) Notice: Subject to any disclaimer, the term of this patent is extended or adjusted under 35 U.S.C. 154(b) by 26 days.

(21) Appl. No.: 10/961,121

(22) Filed: Oct. 8, 2004

(65) Prior Publication Data

US 2006/0075770 A1 Apr. 13, 2006

(51) Int. Cl.
*F25D 3/08* (2006.01)

(52) U.S. Cl. ..... 62/457.4; 62/530

(58) Field of Classification Search ..... 62/457.4, 62/457.2, 457.3, 530, 371
See application file for complete search history.

(56) References Cited

U.S. PATENT DOCUMENTS

| | | | | |
|---|---|---|---|---|
| 3,220,684 | A * | 11/1965 | Milne | 248/346.11 |
| 3,610,456 | A * | 10/1971 | Marsh | 215/376 |
| 4,088,250 | A | 5/1978 | Schaefer | |
| 4,089,498 | A * | 5/1978 | Woodruff | 248/346.11 |
| 4,433,823 | A | 2/1984 | Pearson | |
| 4,570,454 | A | 2/1986 | Campbell | |
| 4,759,524 | A | 7/1988 | Anderson | |
| 4,858,873 | A | 8/1989 | Wilmoth et al. | |
| D305,195 | S | 12/1989 | Towers et al. | |
| 4,928,848 | A | 5/1990 | Ballway | |
| D312,028 | S | 11/1990 | Pinette, Jr. | |
| D312,191 | S | 11/1990 | Pinette, Jr. | |
| D316,014 | S | 4/1991 | Pinette, Jr. | |
| D316,501 | S | 4/1991 | Pinette, Jr. | |
| 5,018,695 | A | 5/1991 | Bishop | |
| 5,284,028 | A | 2/1994 | Stuhmer | |
| D369,281 | S | 4/1996 | Cowell | |
| D371,054 | S | 6/1996 | Henderson | |
| 5,695,270 | A | 12/1997 | Collet | |
| 5,775,659 | A | 7/1998 | Hartlaub et al. | |
| D402,162 | S | 12/1998 | Hagar | |
| 5,861,201 | A | 1/1999 | Blackwelder et al. | |
| 5,938,162 | A | 8/1999 | Honjo | |
| 5,944,024 | A | 8/1999 | Ambrosio et al. | |
| 6,058,735 | A | 5/2000 | Nathan | |
| 6,101,838 | A * | 8/2000 | Teague | 62/457.4 |
| 6,102,352 | A | 8/2000 | Kvalvog | |
| D439,805 | S | 4/2001 | Krohn | |
| 6,231,196 | B1 * | 5/2001 | Mahachek | 359/838 |
| 6,252,494 | B1 | 6/2001 | Howell | |
| 6,354,711 | B1 | 3/2002 | McCoy | |

(Continued)

OTHER PUBLICATIONS

Frosted Coaster; http://www.mprinted.com/Products/1803300/MC250.htm; printed May 26, 2004.

(Continued)

*Primary Examiner*—Melvin Jones
(74) *Attorney, Agent, or Firm*—Banner & Witcoff, Ltd.

(57) ABSTRACT

A coaster for a beverage container has an enclosed base and a cooling material encapsulated therein. The enclosed base has a top surface with a substantially planar portion. The beverage container engages on the top surface of the base. In another embodiment, a coaster assembly has a base portion and a collar portion. The collar portion attaches to the base portion and reveals at least a portion of a top side of the base portion.

27 Claims, 8 Drawing Sheets

U.S. PATENT DOCUMENTS 6,484,425 B1 * 11/2002 Hirsch ..... 40/406
6,619,608 B1 9/2003 Mulvey et al.
6,629,431 B1 10/2003 Robertson
6,637,447 B2 10/2003 McMullin et al.
6,695,272 B1 2/2004 Bomgaars et al.
6,786,062 B1 * 9/2004 Greenberg ..... 62/457.4
7,124,604 B2 10/2006 Taylor et al.

OTHER PUBLICATIONS

The Pampered Chef Fall/Winter 2004 Catalog; *Chillzanne® Ice Bucket*; 2004; 3 pages; The Pampered Chef, Ltd.

* cited by examiner

COASTER

TECHNICAL FIELD

The present invention relates to beverage coasters.

BACKGROUND OF THE INVENTION

Coasters are typically small pieces of wood, plastic, stone, paper, or other material people put on a surface (i.e., a wood table). Coasters protect the surface from heat of a beverage (e.g., hot tea or coffee) or liquid formed by the beverage (e.g., formed by condensation on the outside wall of a cold drink). Coasters may also be decorative in nature. They may be printed or embedded with promotional logos.

Sometimes, it is necessary or desirable that the temperature of a cold drink be maintained or a warm drink be cooled down and then kept cool for an extended period of time, e.g., for at least half an hour. There is a need for a coaster that can keep a drink cold for an extended period of time.

SUMMARY OF THE INVENTION

Applicants have discovered that by using a cooling material inside a coaster, the temperature of a cold drink can be effectively maintained (or even lowered) or the temperature of a warm beverage or drink can be effectively lowered for an extended period of time.

Thus, one embodiment of the present invention provides a coaster for a beverage container. The coaster includes an enclosed base and a cooling material. The base has a top surface with a substantially planar portion for engaging the beverage container. The cooling material is completely encapsulated within the base.

In another embodiment of the present invention, a coaster assembly for a beverage container is provided. The coaster assembly includes a base portion having a top side and a bottom side; and a collar portion. The collar portion attaches to the base portion and reveals at least a portion of the top side of the base portion.

In yet another embodiment of the present invention, a cooling coaster is provided. The cooling coaster includes a base portion having a top surface for receiving a beverage container. The cooling coaster also includes a material located within the base portion. The material has a cooling state and a room temperature state. The cooling state is at a temperature less than room temperature. The room temperature state is at room temperature. The material is in the cooling state before the beverage is in contact with the top surface, and the material warms towards the room temperature state while the beverage is in contact with the top surface.

Other features and advantages of the invention will be apparent from the following specification taken in conjunction with the following drawings.

DETAILED DESCRIPTION OF THE INVENTION

Figure 1:
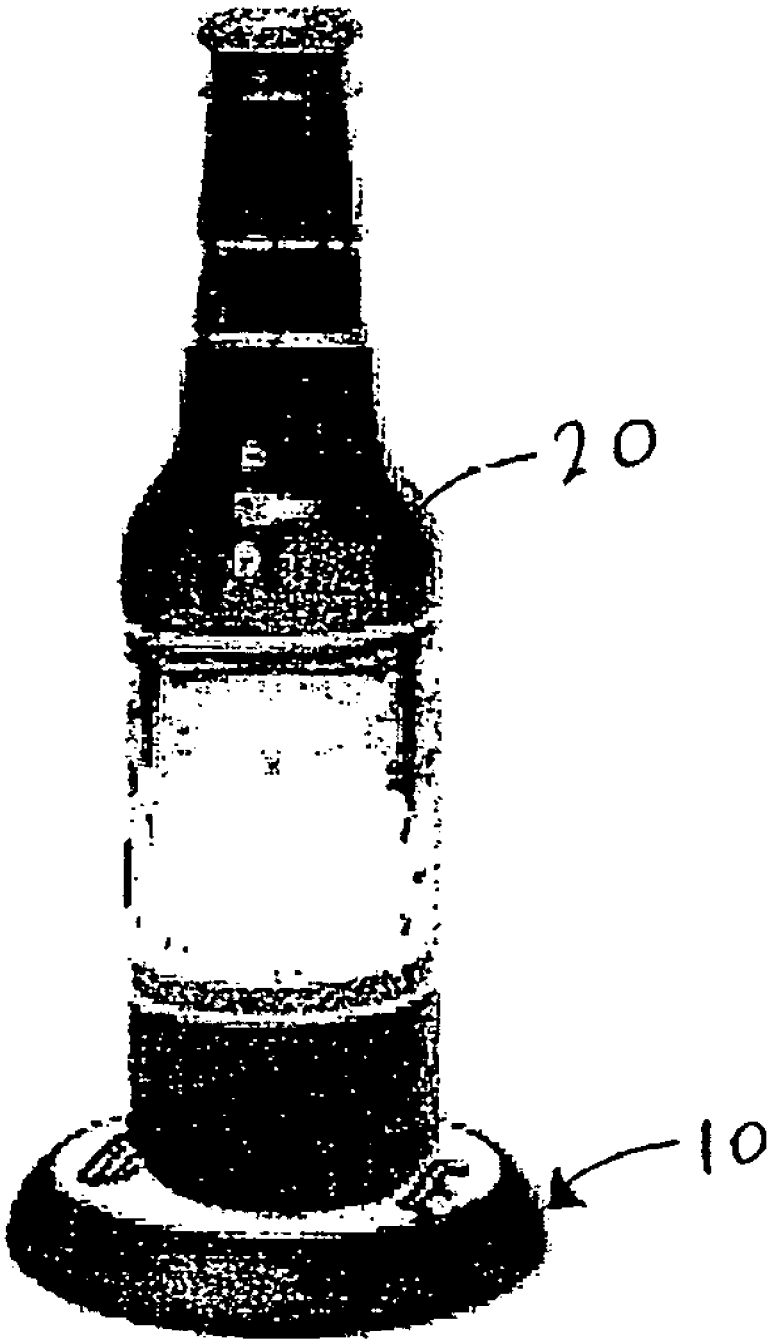
FIG. 1 is a perspective view of one embodiment of the coaster of the present invention in use.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

As shown in FIGS. 1-8, a coaster for a beverage container is provided. The beverage container may be anything that holds a beverage, including for example, a beer bottle, can of beer, a glass of water, a cup of a soft drink or any other receptacle for a liquid.

Figure 2:
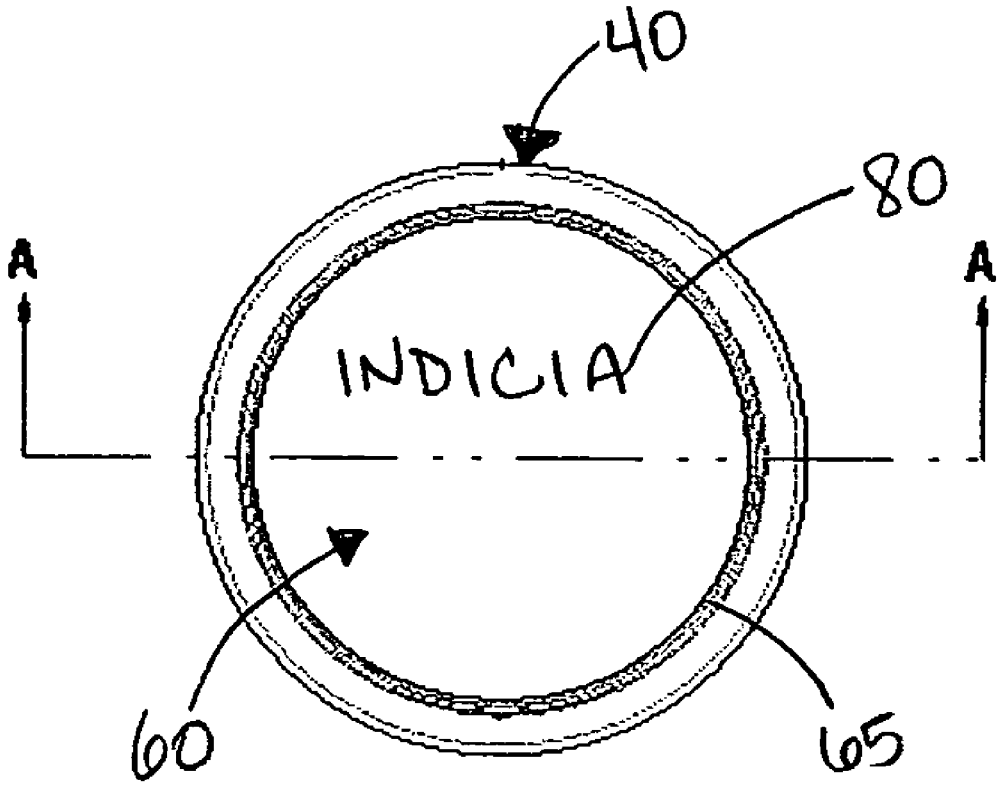
FIG. 2 is a top view of the coaster shown in FIG. 1.
Figure 3:
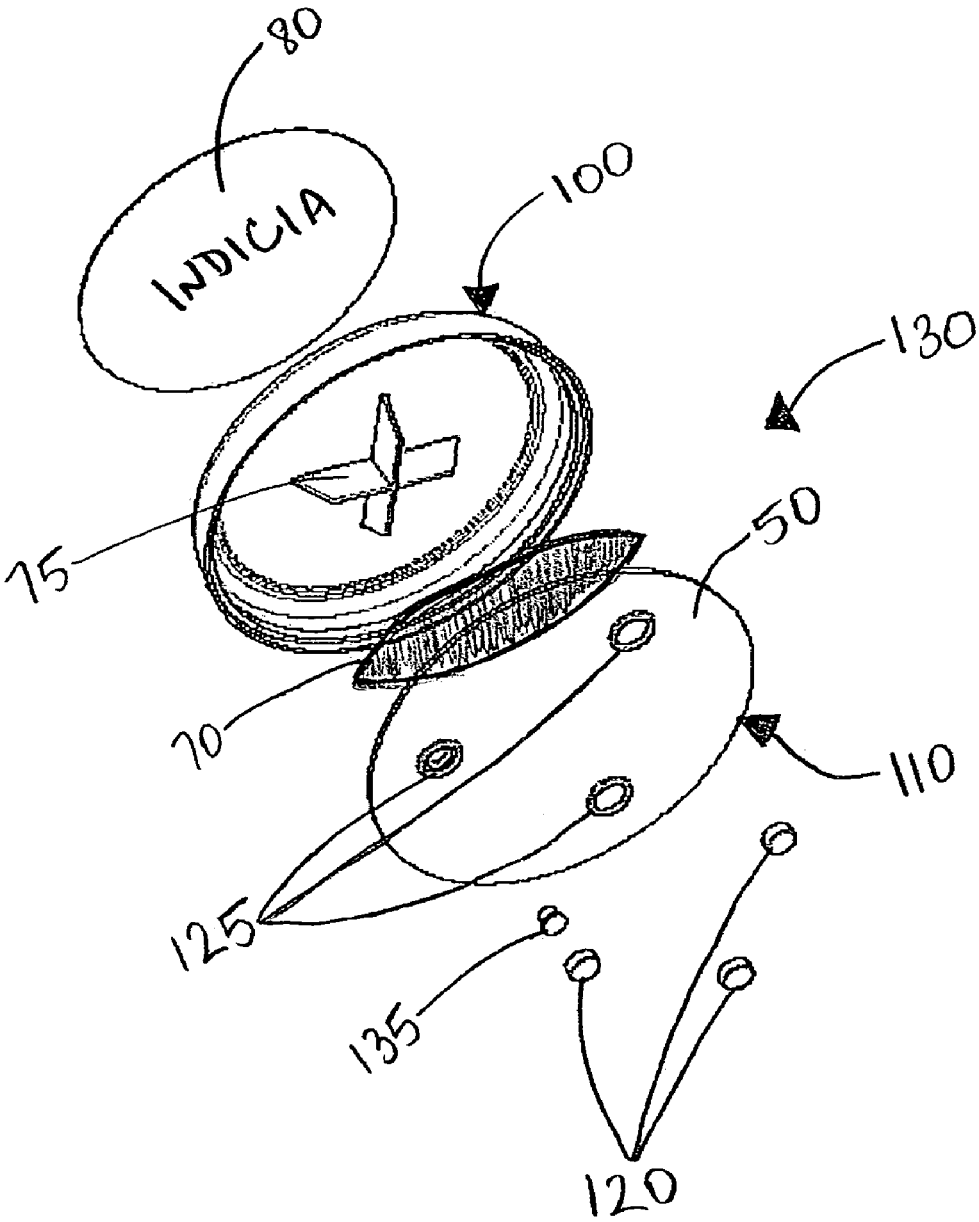
FIG. 3 is an exploded perspective view of the coaster shown in FIG. 1.
Figure 4:
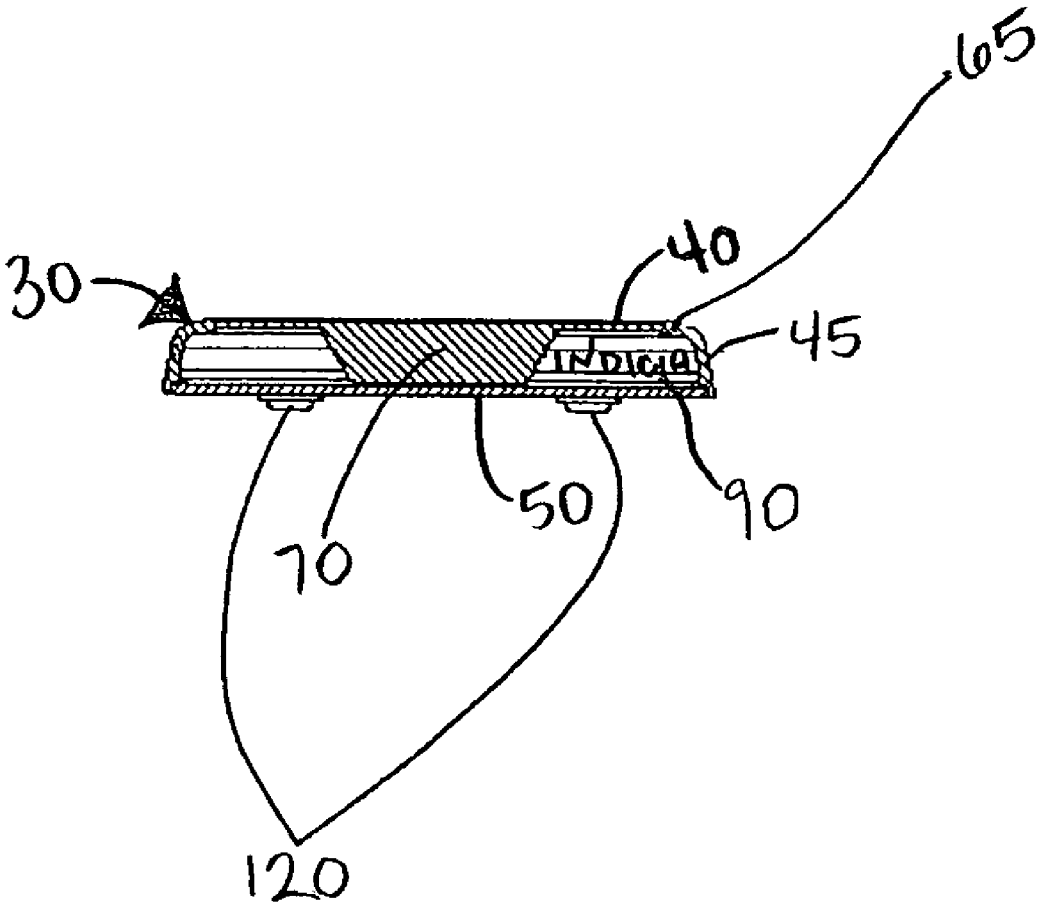
FIG. 4 is a sectional view of the coaster shown in FIG. 1 taken through line A-A of FIG. 2.

Referring to FIG. 1, coaster 10 is shown. Beverage container 20 rests on top of coaster 10. Coaster 10 can be in any shape or form. For instance, coaster 10 may be circular with an indicia showing the sports logo of an educational institution, or pentagonal with an indicia showing the logo of a professional sports team. In addition, the coaster assembly of this invention can be square, triangular, hexagonal or any other shape. Turning to FIGS. 2, 3 and 4, coaster 10 includes a base 30 and a cooling material 70.

Coaster 10 has two states: a cooling state and a room temperature state. The cooling state is at or below 32° F. The room temperature state is at room temperature, which is warmer than the cooling state. To utilize the cooling aspect of the present invention, the coaster should be preferably brought to the cooling state. This may be accomplished by placing the coaster in the freezer (e.g., for 45 minutes to an hour) or in a cool location. It should be understood that the coaster does not need to be brought completely down in temperature to the cooling state for this aspect of the present invention to function. The beverage is placed in contact with the top of the base 30 while the coaster is in (or near) the cooling state. The cooling material 70 cools or maintains a cool temperature of beverage container 20. As time passes, cooling material 70 slowly warms and eventually reaches the room temperature state.

This embodiment of the coaster of the present invention is capable of keeping a drink cold for an unexpectedly long period of time. Specifically, using the coaster of the present invention over a period of 60 minutes, the temperature of a cold beer typically rises less than 10° F. The temperature change of the same cold beer that was placed on a standard coaster typically rises 20-25° F.

Base 30 has a top surface 40, a body 45 and a bottom surface 50. Top surface 40 has a substantially planar portion 60 for engaging beverage container 20. Substantially planar portion 60 may extend throughout the entirety of top surface 40. The bottle of beverage container 20 rests flatly on substantially planar portion 60. Ideally, top surface 40 is a textured polycarbonate decal. This both prevents a buildup of condensation of top surface 40, as well as prevents beverage container 20 from slipping relative to top surface 40. Alternatively, top surface 40 is smooth.

Top surface 40 also may include a raised lip 65. Lip 65 surrounds the bottom of beverage container 20 when coaster 10 is in use, and aids in reducing the chance beverage container 20 falls off coaster 10. Specifically, lip 65 may completely or partially surround a particular circumference within top surface 40. Lip 65 need not contact the bottom of beverage container 20. Lip 65 extends perpendicular to top surface 40 a distance of approximately 2-4 millimeters.

In the preferred embodiment, top surface 40, body 45 and bottom surface 50 are also made of plastic such as high impact polystyrene, ABS plastic or polyethylene. Base 30 may be of any height sufficient to contain an appropriate amount of cooling material, and preferably is three quarters of an inch.

Base 30 may be comprised of one single integral piece. Alternatively, it consists of two separate pieces, a first piece 100 and a second piece 110 as shown in FIG. 3. First piece 100 and second piece 110 may fit snugly together, or alternatively be spin welded or ultrasonically welded together. By spin welded, applicants mean that heat melts first piece 100 into second piece 110 so that they are affixed together. By spin welding, first piece 100 is hermetically sealed with second piece 110.

Top surface 40 optionally includes indicia 80. Body 45 of base 30 may also optionally include indicia 90. Indicia 80 and 90 may be part of or affixed to top surface 40 and body 45 respectively. The indicia may include, for example, a slogan (e.g., "Go Bears"), a photograph of an athlete or player, or a logo of a sports team (e.g., the Chicago Bears®) or an institution (e.g., The Ohio State University®), or any other promotional message.

Bottom surface 50 may also include pads 120 as shown in FIGS. 3 and 4. The pads are designed to rest on the surface to be protected such as a wood table. The pads are also designed to fit within lip 65 to facilitate the stacking of multiple coasters. Because there may be condensation on bottom surface 50 of coaster 10 in the cooled state, it is desirable to prevent bottom 50 from directly contacting the surface to be protected. Pads separate bottom 50 from this surface to be protected and allow for air flow. Preferably, three pads 120 are provided. Three pads result in a stable and balanced coaster. Alternatively, one large pad or four smaller pads may be included at the center of base surface 50.

Bottom surface 50 may also include an opening 125. During assembly of coaster 10, cooling material 70 may be injected or inserted through opening 125 into base 30. Plug 135 or other suitable structure blocks opening 125 after coaster 10 is filled with cooling material 70. One of pads 120 may cover plug 135.

Coaster 10 includes cooling material 70. In the assembled coaster 10, cooling material 70 is completely encapsulated within base 30. Cooling material 70 may be a gel or a liquid at room temperature. One advantage of a gel is that it does not move around as easily or quickly in the coaster. Users of the coasters may not like the sound of the liquid within the coaster. The cooling material has a freezing point in the range of 6° to 32° F. and preferably does not freeze when placed in a standard temperature freezer, which is typically approximately 20° F. If a liquid, cooling material 70 preferably includes polypropylene glycol. It is believed that polypropylene glycol is generally recognized as safe in the event some cooling material contacts with the liquid to be consumed by a user. For example, a liquid cooling material 70 may include a mixture of water and polypropylene glycol. If a gel, cooling material 70 preferably includes polypropylene glycol, gelatin and water. Other gel cooling materials are a mixture of carboxyl methyl cellulose and water (preferably 3% carboxyl methyl cellulose and 97% water); Evercold gel manufactured by Cold Ice, Inc. of California with water; Ecogel manufactured by Pelton Shepherd Industries; water; or any other cooling material as known to those of skill in the art.

Cooling material 70 does not completely fill the volume defined by the space within base 30. Cooling material 70 expands as it warms. Thus, the actual volume occupied by cooling material 70 will vary depending upon the temperature of the cooling material. The space defined by the inside of base 30 at room temperature is between 80% and 95% and preferably 90% filled with cooling material 70, the remainder being air.

Referring to FIG. 3, base 30 additionally may include a baffle 75 within the space between and defined by the top surface 40, body 45 and the bottom surface 50. Baffle 75 serves several purposes. First, it prevents cooling material 70 from adjusting substantially during movement of coaster 10. Baffle 75 can function as a barrier to the free flowing of cooling material 70 and thus reduces or even eliminates the potential noise caused by the flowing. Additionally, baffle 75 provides further structural support and stability for beverage container 20. The baffle may be in the form of a cross, two short sticks in parallel, a triangle, or may utilize six or even eight separate bars. The baffle does not need to extend all of the way to the periphery of base 30.

Figure 5:
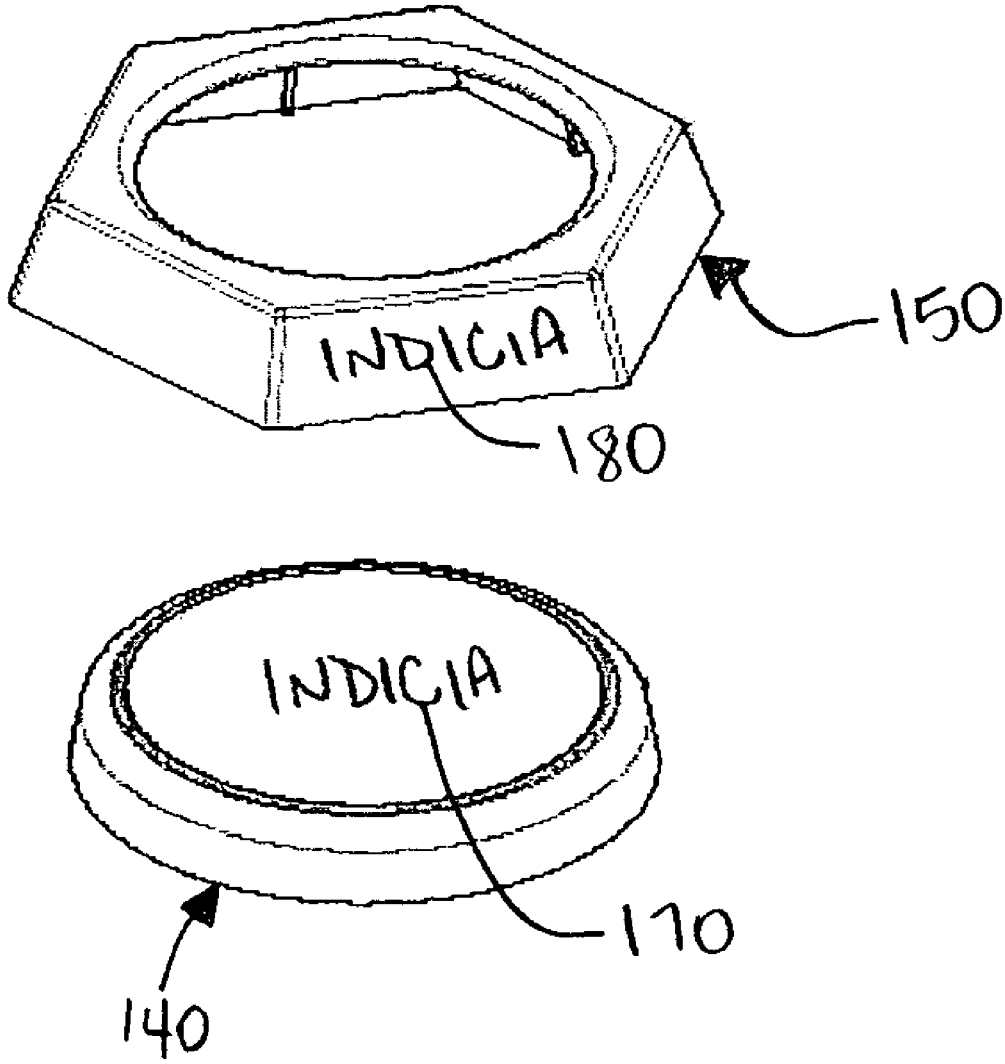
FIG. 5 is an exploded perspective view of another embodiment of the coaster assembly of the present invention.
Figure 6:
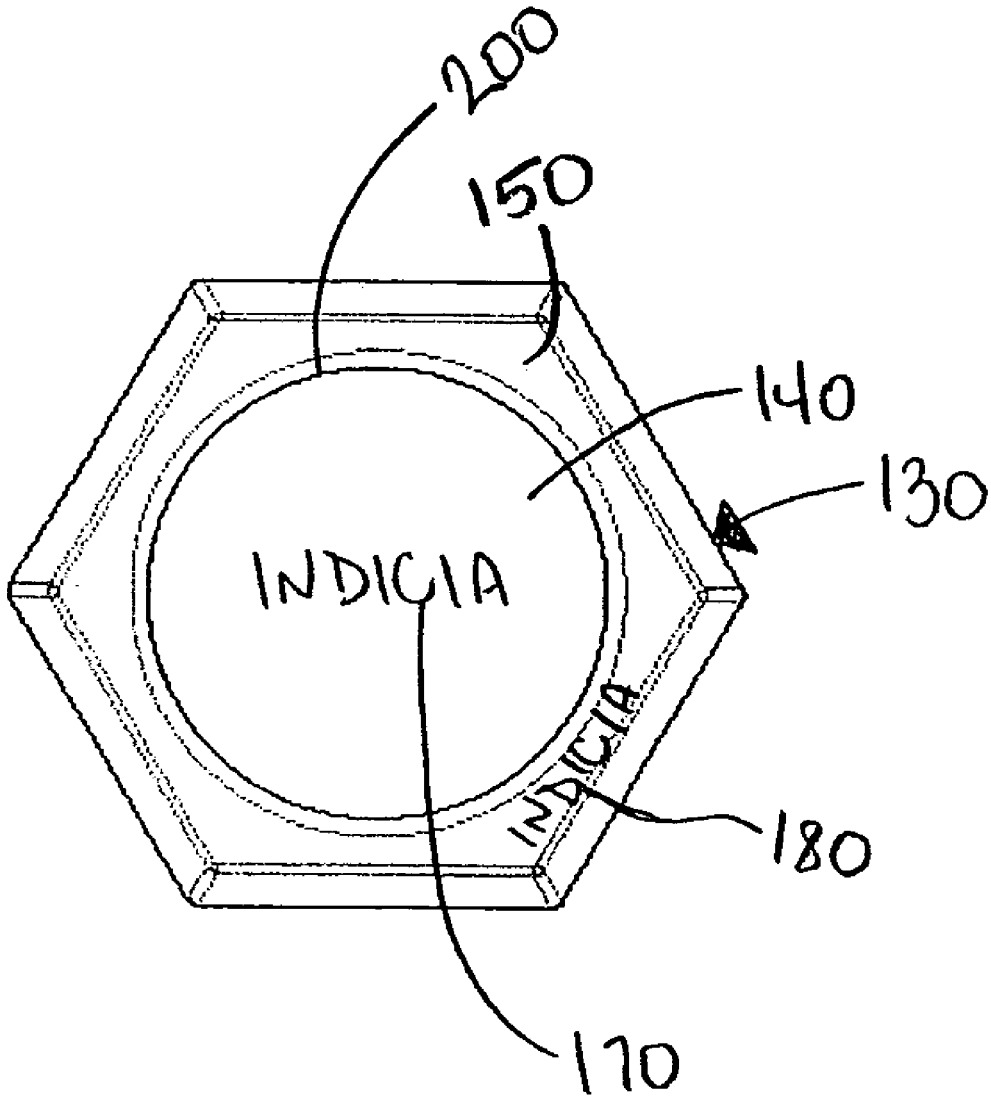
FIG. 6 is a top view of the embodiment of the coaster assembly shown in FIG. 5.
Figure 7:
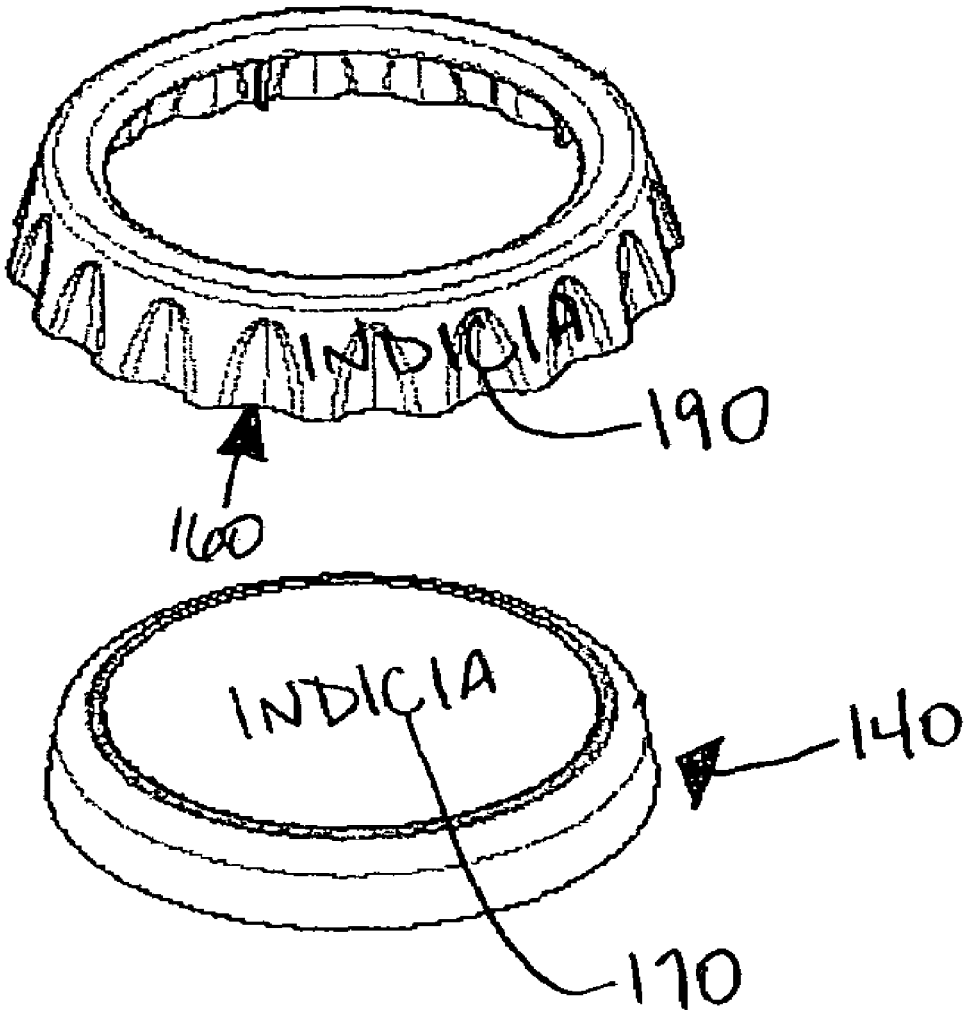
FIG. 7 is an exploded perspective view of another embodiment of the coaster assembly of the present invention.
Figure 8:
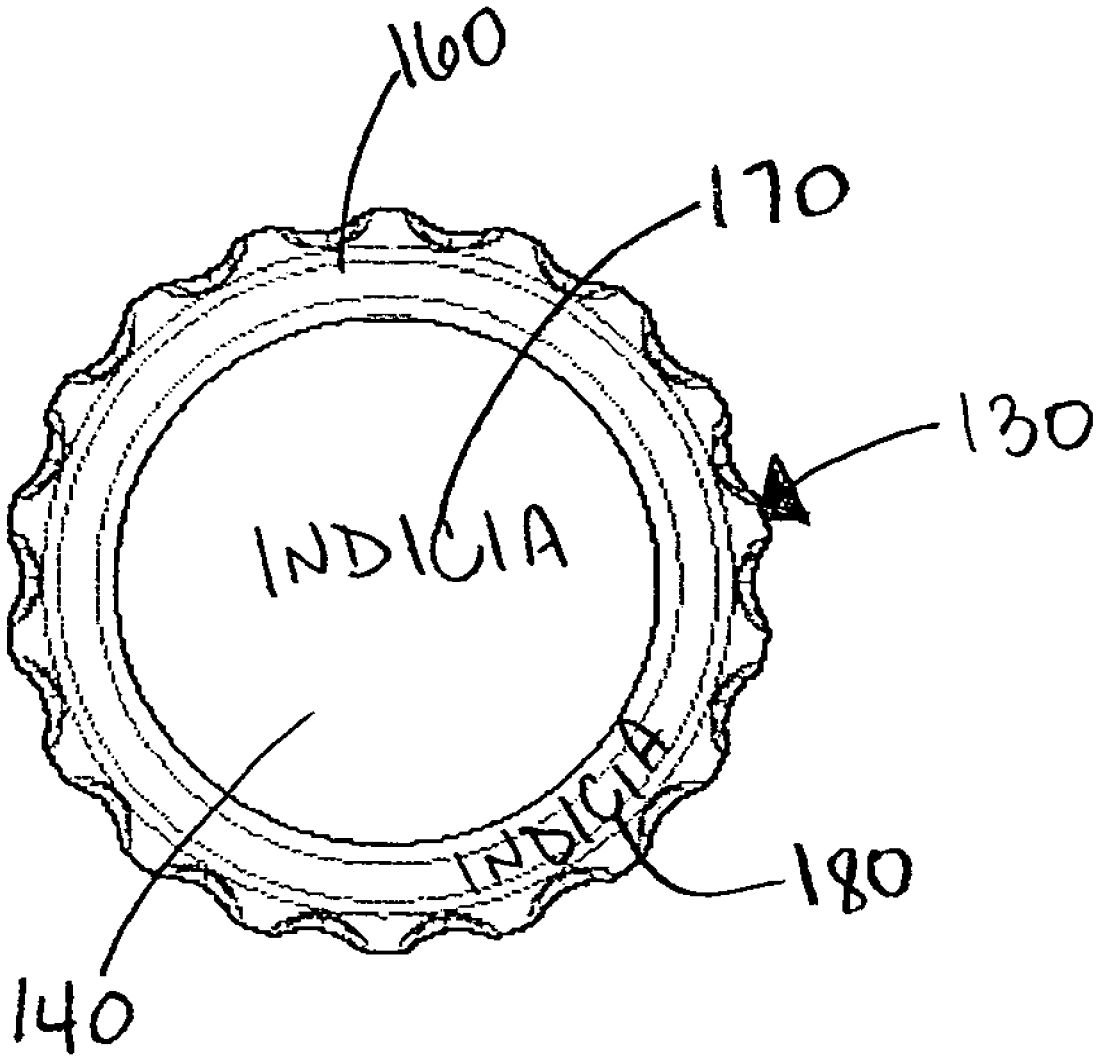
FIG. 8 is a top view of the embodiment of the coaster assembly shown in FIG. 7.

Referring now to FIGS. 5 and 6, an alternative embodiment of the present invention is illustrated. In this alternative embodiment, the cooling material described above may optionally be used, but is not necessary. Coaster assembly 130 includes base portion 140 and first collar portion 150. FIGS. 7 and 8 show yet another embodiment of the present invention. The collar portions may be of any shape including circular. Base portion 140 forms a ridge 200 relative to first collar portion 150. This ridge is preferably perpendicular to the base portion and aids in preventing slippage of the beverage container and formation of moisture. Ridge 200 is preferably 32 millimeters in height. As shown in FIGS. 7 and 8, coaster assembly 130 may also include a second collar portion 160. First collar portion 150 and second collar portion 160 do not receive condensation from the beverage or otherwise.

Referring again to FIGS. 5 and 6, first collar portion 150 may be fixedly or removably connected to base portion 140. First and second collar portions 140 and 150 cannot be connected to base portion 140 at the same time, and are each capable of being separately removably connected to base portion 140. Collar portions may snugly fit together with base portion 140 by use of clips on the collar or be secured by other means such as sealing with a glue or by ultrasonic welding. The collar portions may be configured to depict a distinctive object such as a baseball stadium, bottle cap, poker chip or the tread of a tire. They may be of different shapes such as circular, hexagonal, or triangular. The collar portions cover a portion of base portion 140, and reveal at least a portion of the top side of the base portion.

Base portion 140, and first and second collar portions 150 and 160 may have indicia 170, 180 and 190 respectively. Base indicia 170 may be the same or related to first collar indicia 180 or second collar indicia 190. For example, the indicia may be different logos or slogans advertising the same product or sports team. Alternatively, the indicia may be different corporate sponsors of the same event. The area of the top side of the base portion revealed by the collar portion may have indicia.

The coaster assembly of the present invention can be made (and sold) either as a single piece or as a whole set with a number of different logos, e.g., of sports teams of a league or a NCAA conference school. For instance, a set of this coaster can have the logos of all eleven schools of the Big Ten® conference. Additionally, these 11 coaster assemblies can be stacked together and placed in a rack, which also bears the logos of all teams.

All figures included herein are for demonstrative purposes and are not intended to limit in any way the scope of this invention. Unless otherwise defined, all terms recited herein refer to their ordinary meanings, including those commonly accepted by a person skilled in the art. Thus, they are hereby incorporated by reference.

It is understood that various modifications can be made to the coaster of this invention as described above and that they do not depart from, and thus are also within the scope of, this invention.

What is claimed is:

1. A coaster for a beverage container comprising:

an enclosed base with a substantially-planar top surface for engaging the beverage container; and a cooling material comprising a gel encapsulated within the base, wherein indicia is present on the top surface.

2. A coaster for a beverage container comprising:

an enclosed base with a substantially-planar top surface for engaging the beverage container; and a cooling material including polypropylene glycol encapsulated within the base, wherein indicia is present on the top surface.

3. A coaster for a beverage container comprising:

an enclosed base with a substantially-planar top surface for engaging the beverage container; and a cooling material encapsulated within the base, wherein indicia is present on the top surface, wherein the cooling material occupies between 80 to 95% of an interior space of the enclosed base.

4. The coaster of claim 1 wherein the base is comprised of a first and a second piece.

5. A coaster for a beverage container comprising:

an enclosed base with a substantially-planar top surface for engaging the beverage container; and a cooling material encapsulated within the base, wherein indicia is present on the top surface, and wherein a first peripheral portion that is connected to the base portion.

6. A coaster assembly for a beverage container comprising:

a base portion containing cooling material having a top side and a bottom side;

a collar portion wherein the collar portion attaches to the base portion and reveals at least a portion of the top side of the base portion.

7. The coaster assembly of claim 6 wherein the area on the top side of the base portion revealed by the collar has indicia.

8. The coaster assembly of claim 6 wherein the collar portion has indicia, the indicia of the collar portion being related to the indicia of the base portion.

9. The coaster assembly of claim 6 comprising a second collar portion, the collar portion and second collar portion each capable of being separately removably connected to the base portion.

10. The coaster assembly of claim 6 wherein the collar portion is snugly fit to the base portion.

11. The coaster assembly of claim 6 wherein the cooling material contains polyethylene glycol.

12. The coaster assembly of claim 6 wherein the collar portion is configured to depict a distinctive object.

13. A cooling coaster comprising:

a base portion having a top surface for receiving a beverage container; and a material located within the base portion having a cooling state and a room temperature state, the cooling state being at a temperature less than room temperature, wherein the material is in the cooling state before the beverage is in contact with the top surface, and the material warms towards the room temperature state while the beverage is in contact with the top surface.

14. A coaster for supporting a container and for cooling a beverage contained within the container, the coaster comprising:

a base comprising a top surface, a body and a bottom surface, the top surface of the base being circular in shape and having a center point and raised lip, wherein the raised lip extends along the circumference of the top surface of the base, wherein the top surface of the base has a substantially planar portion extending from the center point of the top surface of the base to an inner edge of the raised lip, wherein the raised lip is perpendicular to the substantially planar portion of the top surface of the base; and a cooling material completely encapsulated within the base of the coaster, the cooling material having a cooling state equal to or less than 32° F.

15. The coaster of claim 14 further comprising a baffle within the base of the coaster.

16. The coaster of claim 6 wherein the cooling material is a gel.

17. The coaster of claim 6 wherein the cooling material is a liquid.

18. The coaster of claim 6 wherein the cooling material occupies between 80 to 95% of an interior space of the enclosed base.

19. The coaster of claim 6 wherein the base is comprised of a first and a second piece.

20. The coaster of claim 13 wherein the cooling material is a gel.

21. The coaster of claim 13 wherein the cooling material is a liquid.

22. The coaster of claim 13 wherein the cooling material includes polypropylene glycol.

23. The coaster of claim 13 wherein the base is comprised of a first and a second piece.

24. The coaster of claim 14 wherein the cooling material is a gel.

25. The coaster of claim 14 wherein the cooling material is a liquid.

26. The coaster of claim 14 wherein the cooling material occupies between 80 to 95% of an interior space of the enclosed base.

27. The coaster of claim 14 wherein the base is comprised of a first and a second piece.

* * * * *